US005274366A

United States Patent [19]

Hayashi et al.

[11] Patent Number: 5,274,366

[45] Date of Patent: Dec. 28, 1993

[54] DRIVING CIRCUIT FOR LIQUID CRYSTAL DISPLAY APPARATUS

[75] Inventors: Masatomo Hayashi, Yamatokoriyama; Taiji Iizuka, Nara, both of Japan

[73] Assignee: Sharp Kabushiki Kaisha, Osaka, Japan

[21] Appl. No.: 547,130

[22] Filed: Jul. 3, 1990

[30] Foreign Application Priority Data

Jul. 6, 1989 [JP] Japan ..... 1-175252

[51] Int. Cl.[5] ..... G09G 3/36

[52] U.S. Cl. ..... 345/103; 345/96

[58] Field of Search ..... 340/765, 784, 805, 811; 358/236

[56] References Cited

U.S. PATENT DOCUMENTS 4,525,710 6/1985 Hoshi et al. ..... 340/784

4,965,566 10/1990 Kawamura et al. ..... 340/784

FOREIGN PATENT DOCUMENTS 0244978 11/1987 European Pat. Off. .

1-106017 4/1989 Japan .

OTHER PUBLICATIONS

Fundamentals of Logic Design, Charles H. Roth, Jr., 1979, pp. 257-258.

*Primary Examiner*—Jeffery Brier

[57] ABSTRACT

A display circuit for a simple matrix type liquid crystal display apparatus which is multiduty. The picture element data of one line portion is sequentially output through the segment driver into one electrode contacting the liquid crystal. The scanning pulses are sequentially output through the command driver into the other electrode contacting the liquid crystal. The driving circuit further reverses the polarities of the outputs at a constant period with an alternating signal, so as to drive the respective liquid crystal.

5 Claims, 6 Drawing Sheets

DRIVING CIRCUIT FOR LIQUID CRYSTAL DISPLAY APPARATUS

BACKGROUND OF THE INVENTION

The present invention generally relates to a driving circuit for a simple matrix type liquid crystal display apparatus of multiduty, which sequentially outputs, respectively, the picture element data of one line portion through the segment driver into one electrode contacting the liquid crystal, scanning pulses through the common driver into the other electrode contacting the liquid crystal, reversing the polarities of the outputs at a constant period with an alternating signal so as to drive the respective liquid crystal.

Generally, in the simple matrix type liquid crystal display apparatus of multiduty, electrolysis is caused in the liquid crystal. This occurs when the direct current voltage is continuously applied upon the liquid crystal which becomes each picture element, to shorten the service life. The polarities of the voltage signals corresponding to the picture element data and the scanning pulses are reversed and applied upon one or the other electrodes contacting liquid crystal for each of given periods (for example, one frame scanning time) by the alternating signals, so as to turn the average voltage to be applied upon the liquid crystal to zero.

The above described alternating signal is conventionally generated by an alternating signal generating circuit composed of a NAND gate 1 and a D-flip-flop 2 shown in FIG. 4. Namely, the NAND gate 1 receives a frame scanning start signal YD (see FIG. 5(*a*)) to be inputted at each scanning start of one frame, and the latch pulse LP (see FIG. 5 (*b*)) to be inputted at each latching of the picture element data of one line portion, to reverse the logical product of both the signals for outputting the set signal D (see FIG. 5(*c*)) into the D-flip-flop 2. The D-flip-flop 2 outputs into an output terminal Q through a reset terminal $\overline{D}$ the signal of a reversion output terminal $\overline{Q}$ at each rising of the set signal D, to get such an alternating signal FR as shown in FIG. 5(*d*).

FIG. 6 shows a driving circuit for a simple matrix type liquid crystal display apparatus of the conventional multiduty type, adopting a system of reversing the polarities of the picture element data, scanning pulses by the above described alternating signal FR. The driving circuit is composed of a segment driver 12 for sequentially outputting, one line portion, by one line portion the picture element data into the one longitudinal direction of a seven line shaped electrode contacting the liquid crystal matrix 11 which composes the thirty five picture elements of 5×7, and a common driver 13 for sequentially outputting in a row direction the scanning pulses into the other lateral direction five line shaped electrode contacting above described the liquid crystal. The binary ("0", "1") picture element data D1, . . ., D7 of seven per line are synchronized with a clock XCK, is accommodated into the shift register 14 of the segment driver 12, and is retained for one horizontal scanning period into a data latch 15 receiving the latch pulse LP. A level converter 16 and an analog switch 17 composed of many transistors adjusted in level, convert seven input signals of "0" or "1" from the data latch 15 into four operation voltage values V5, V0, V3, V2 to be selected by the voltage value selection switches 18, 19 in accordance with the "H", "L" of the alternating signal FR by on signal and off signal so as to effect parallel output into the one seven line shaped electrodes.

The shift register 20 of the common driver 13 synchronizes, to the latch pulse LP to be inputted for each one horizontal scanning operation, the frame scanning start signal YD to be inputted at the scanning start time of one frame, so as to shift it. The data latch 21 retains the shifted pulse signal for one horizontal scanning period. The level converter 22 and the analog switch 23 composed of many transistors adjusted in level, convert the five input signals of "0" or "1" from the data latch 21 into four operation voltage values V0, V5, V4, V1 to be selected, respectively, by the voltage value selection switches 24, 25 in accordance with the "H", "L" of the alternating signal FR from the on signal and off signal so as to effect parallel output into the other five line shaped electrodes. Namely, the scanning pulses V0, V5 are sequentially scanned from top to bottom like Ca, Cb, . . . into the five lateral direction line shaped electrodes by the common driver 13. Among the line liquid crystal with the scanning pulses being fed into it, only the liquid crystal with the white level signals V5, V0 being fed into it by the segment driver 12 is displayed.

FIG. 7 is a view showing across a period of two frames, the electrode wave forms to be outputted respectively from the above-described analog switches 17, 23 into both electrodes contacting the electrode by way of the liquid crystal of Cb line S2 row on the picture face. As shown in FIG. 7 (*a*), (*b*), (*c*), the frame scanning start signal YD is outputted as a pulse signal into each frame scanning start time. The latch pulse LP is outputted five times, setting each horizontal scanning in one frame. The D-flip-flop 2 outputs the alternating signal FR which is varied into "H", "L" for each one frame as described hereinabove (see FIGS. 4, 5) in accordance with both the pulses. The analog switch 17 on the side of the segment driver 12 outputs a black level voltage signal of V3 when the FR is "H" as shown in FIG. 7(*d*); a black level voltage signal of V2 when the FR is "L"; outputs a white level voltage signal of V5 when the FR is "H"; a white level voltage signal of V0 when the FR is "L". In the shown example, the respective No. 2 line, No. 4 line of the first and second frames become white levels. As shown in FIG. 7(*e*), the analog switch 23 on the side of the common driver 13 outputs a non-selection level voltage signal of V4 when the FR is the "H", a non-selection level voltage signal of V1 when the FR is the "L", outputs a selection level voltage signal of V0 when the FR is the "H", and a selection level voltage signal of V5 when the FR is "L". In the shown example, the Cb line becomes the selection level, being set to the second latch pulse LP for a period of scanning the Cb line which is the No. 2 line in the first and second frames. Since the voltage signals like FIG. 7 (*d*), (*e*) are applied respectively upon both the electrodes contacting the liquid crystal of the Cb line, the S2 row, the potential difference to be added to the liquid crystal is provided as in FIG. 7(*f*). The above described liquid crystal is too light (display) with voltage |V0–V5| only at the No. 2 line scanning time of the first frame, and too light with the negative voltage—|V-0–V5| only at the second line scanning time of the second frame.

In the above described conventional driving circuit, the picture face of the liquid crystal display apparatus becomes larger, and the wave forms of the output voltage signal from both the drivers 12, 13 shown in FIG. 7

(*f*) become duller when the liquid crystal picture elements to be driven are increased to increase the load. The duller wave forms appear considerably (see FIG. 8(*c*)) when the alternating signal FR changes from the "L" to the "H" or from the "H" to the "L" as shown in FIG. 8(*d*). The output voltage signal from the common driver 13 is much duller. Namely, when the alternating signal FR changes from the "L" to the "H", the non-selection voltage level to be outputted from the common driver 13 changes from V1 to V4. At the same time, after the voltage Ca of the No. 1 line has become V0 in the selection level for only the horizontal scanning period, it returns to the V4 in the non-selection level. Since the voltage variation from the V1 of the voltage Ca to the V0 is small, the circular arc shaped dullness of the wave form corner portion is small, and the voltage variation from the V0 to the V4 is larger, so that the circular arc dullness of the wave form corner portion is larger. Similarly, the voltage Cb of the No. 2 line and the voltage Ce of the No. 5 line are also varied as shown, with the dullness of the wave form corner portion becoming larger as compared with the voltage variation. The black level voltage Lb to be outputted from the segment driver 12 is changed from the V2 to the V3 in accordance with the variation of the FR so as to cause the slight dullness in the wave form corner portion. Therefore, the liquid crystal driving voltage which is the output potential difference of the common driver 13 and the segment driver 12, at the variation time of the alternating signal FR, works in a direction of lowering the potential difference with the dullness of the Ca and the Lb being mutually opposite in direction on the No. 1 line. It is not lowered so much in the potential difference with the dullness of the Cb and the Lb being mutually the same in direction on the No. 2 line. Further, it works in a direction of increasing the potential difference with the dullness of the Ce and the Lb being opposite in direction on the No. 5 line. Thus, the brightness of the line accompanied by the variation in the FR is the darkest in the No. 1 line and is the brightest in the No. 5 line. Thus, the horizontal string shows a constant value of the turbulent picture face of the effective value of the driving signal affected by the variation in the alternating signal FR, with a defect that the display quality is degraded.

SUMMARY OF THE INVENTION

Accordingly, the present invention has been developed with a view to substantially eliminating the above discussed drawbacks and has for an important object to provide an improved driving circuit for a liquid crystal display apparatus.

Another important object of the present invention is to provide a driving circuit for a liquid crystal display apparatus, where the cycle of the latch pulses is increased to be larger than the number of the actual display lines and the plurality of the picture element data and the scanning pulse are reversed within the non-display region so as to improve the display quality.

In accomplishing these and other objects, according to one preferred embodiment of the present invention, there is provided a driving circuit for a liquid crystal display apparatus which is adapted to sequentially output one line portion of picture element data through the segment driver into one electrode contacting the liquid crystal which becomes the picture elements and sequentially output the scanning pulses in the line direction through the common driver into the other electrode contact the liquid crystal. It is also arranged to reverse, for each of the constant periods, the polarity of the above described picture element data and the scanning pulse, with an alternating signal, so as to drive the respective liquid crystal. Further, above described common driver includes a plurality of drivers cascaded together. A frame scanning start signal is adapted to be inputted at a time interval corresponding to the latch pulses which are more, by a few pulses, than the number of the actual display lines. An alternating signal generating means is provided which is adapted to be output as the alternating signal, into the above described segment driver, and the common driver a signal which is delayed a few latch pulse intervals in accordance with the latch pulse of the last line of one frame and is risingly or loweringly varied when the pulse signal, for cascade connection used from the above described driver at the lowermost stage, has been outputted.

When a first frame scanning start signal is inputted into the common driver, in a case where the alternating signal is, for example, "L", the common driver is synchronized with the latch pulses, sequentially from the uppermost stage, so as to sequentially output the positive polarity of scanning pulses, sequentially from the top, into the line shaped electrodes in the line direction of the liquid crystal matrix, at the same time the segment driver is synchronized with the latch pulse, to sequentially output in parallel the positive polarity of picture element data of one portion sequentially from the uppermost line into the line shaped electrode of the row direction. Further, each liquid crystal is driven by the positive polarity of voltage which is equivalent to the difference of the above described scanning pulse and the picture element data, so as to sequentially light up (display) in the row direction from the uppermost line. When the lowermost stage of driver of the common driver drives the lowermost line of the liquid crystal matrix, the pulse signal for the cascade connection use is outputted into the alternating signal generating means from the driver. The alternating signal generating means is delayed by a few latch pulse intervals from the input of the above described pulse signal to risingly vary the alternating signal into the "H", to output it into the common driver and the segment driver. Since the next frame scanning start signal is not yet inputted into the common driver although the scanning pulse and picture element data to be outputted respectively, from both the drivers are reversed into the reverse polarity, the display of the next frame is not performed by the liquid crystal matrix. When the turbulence of the output wave form of the scanning pulse and the picture element data, by the reversion of the alternating signal, has been attenuated, the next frame scanning start signal is inputted. The liquid crystal matrix is driven sequentially from the uppermost line as described hereinabove, by the reverse polarity of voltage corresponding to the difference of the scanning pulse and the picture element data, to effect the lighting operation. Since the polarity of the scanning pulse and the picture element data within the non-display region is reversed, the turbulence of the driving voltage accompanied by the reversion does not appear on the display picture face. Thus display quality is not degraded.

DETAILED DESCRIPTION OF THE INVENTION

Figure 1:
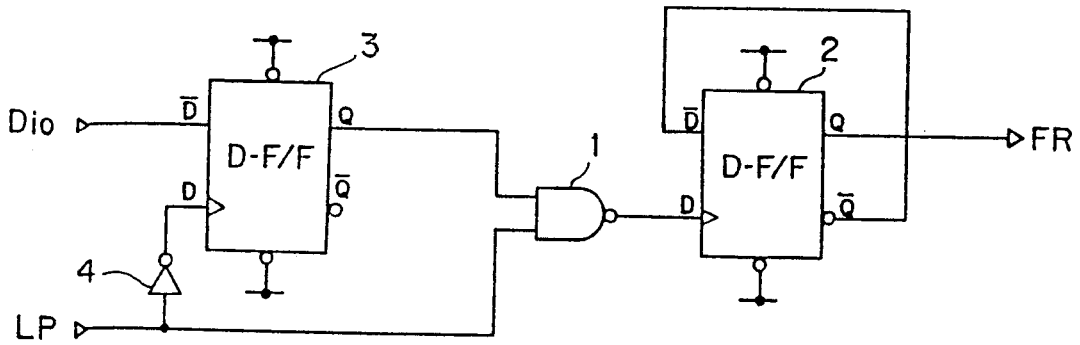
FIG. 1 is a diagram showing one example of an alternating signal generating circuit used in a driving circuit for a liquid crystal display apparatus of the present invention.

Before the description of the present invention proceeds, it is to be noted that like parts are designated by like reference numerals throughout the accompanying drawings.

Figure 4:
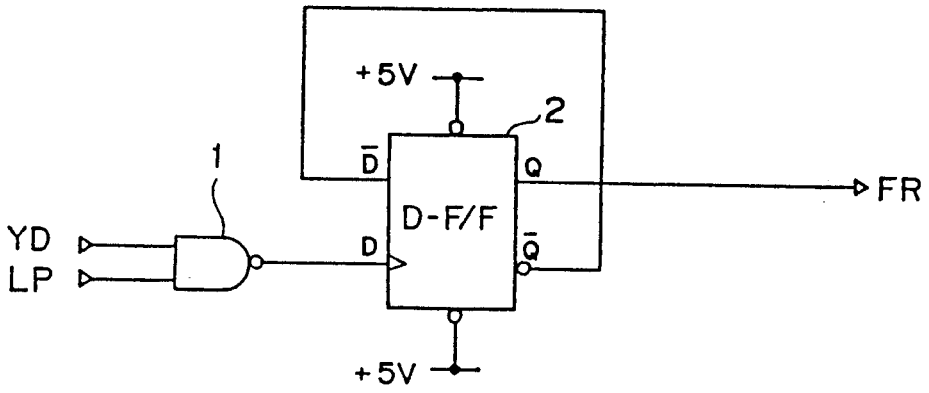
Fig. 4 PRIOR ART
FIG. 4 is a diagram showing the conventional alternating signal generating circuit.

Referring now to the drawings, there is shown in FIG. 1 a block diagram showing one embodiment of an alternating signal generating circuit to be used in the driving circuit of a liquid crystal display according to one preferred embodiment of the present invention. The alternating signal generating circuit has a D-flip-flop 3 provided in the front stage of the NAND gate 1 of the circuit described in FIG. 4. A pulse signal Di0 for cascade connection use to be outputted from the common driver to be described is inputted into the reset terminal $\overline{D}$, a latch pulse LP is inputted through the inverter 4 into the set terminal D. Also, the output Q of the D-flip-flop 3 is inputted into one input terminal of the NAND gate 1, the above described latch pulse LP is inputted into the other input terminal of the NAND gate 1.

Figure 2:
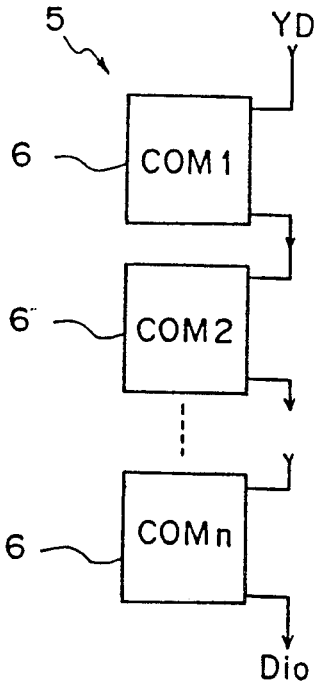
FIG. 2 is a schematic diagram showing a common driver of the above described driving circuit.
Figure 6:
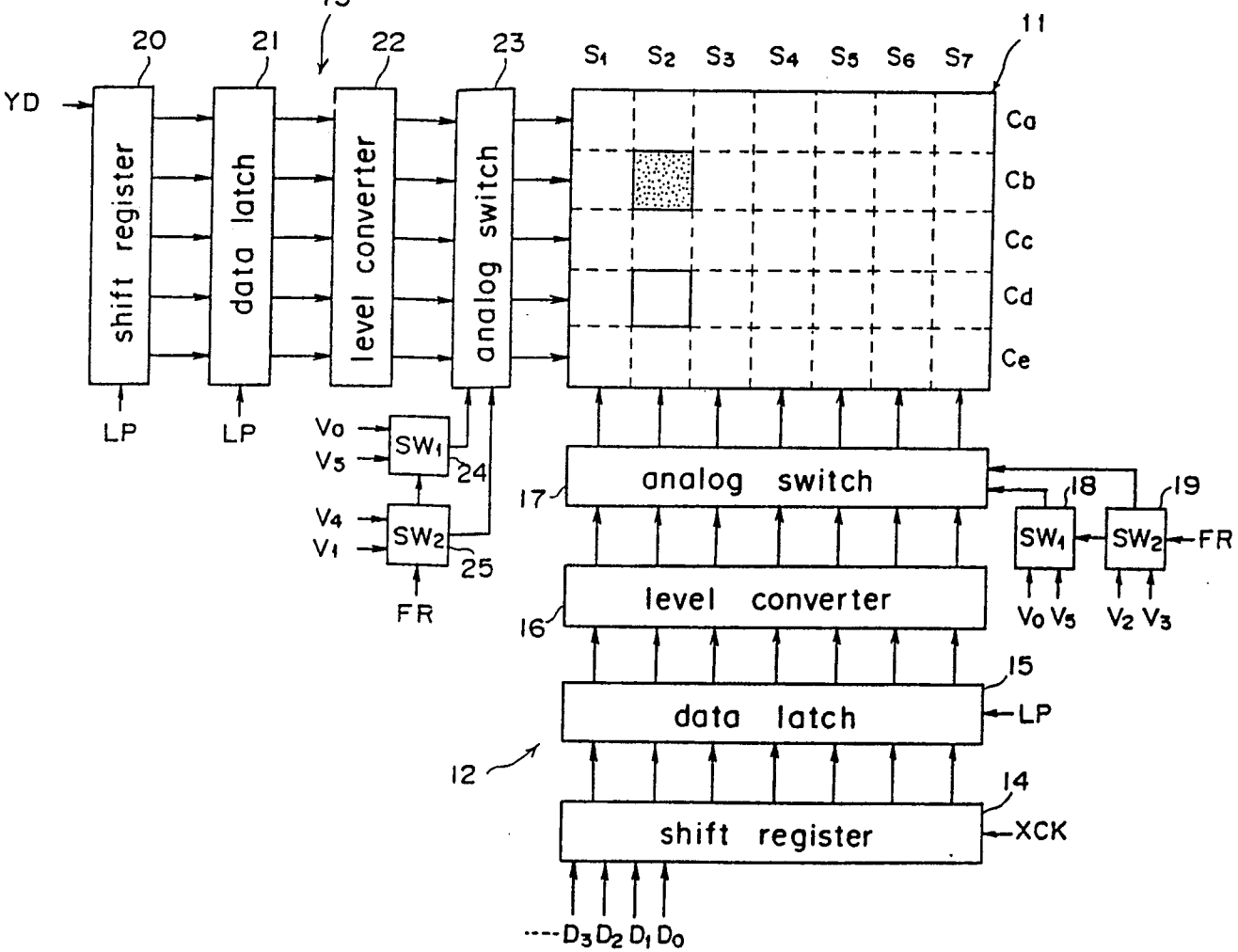
Fig. 6 PRIOR ART
FIG. 6 is a block diagram showing the conventional driving circuit.
Figure 7:
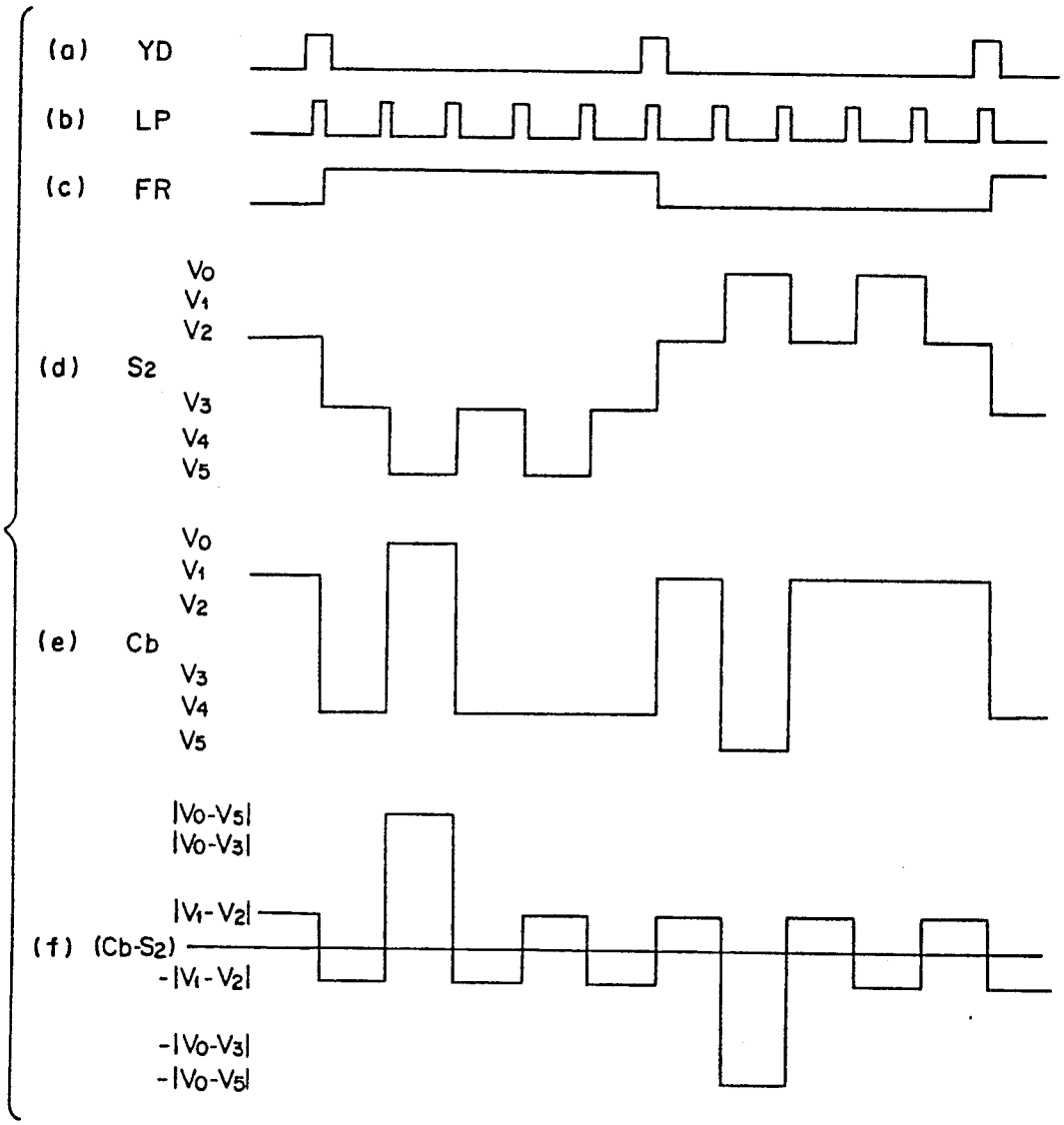
Fig. 7 PRIOR ART
FIG. 7 is a timing chart showing the relationship of the signals of the conventional driving circuit.
Figure 8:
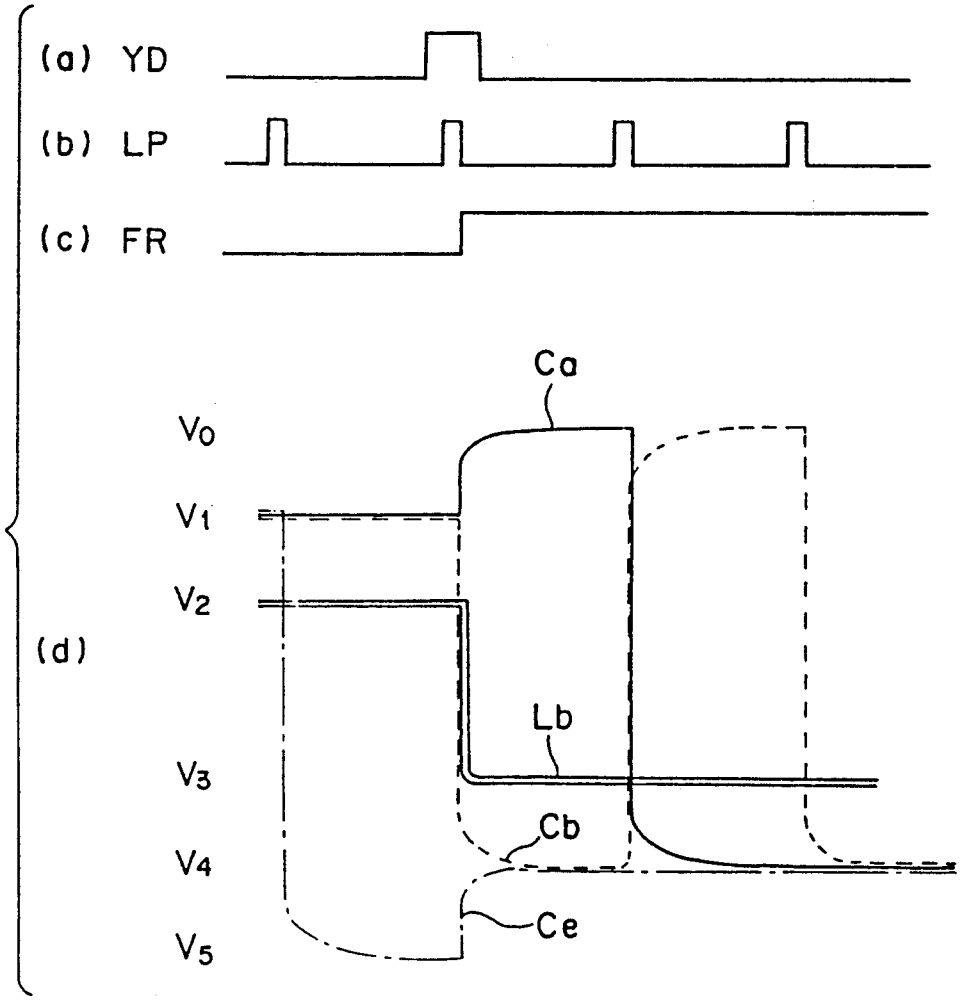
Fig. 8 PRIOR ART
FIG. 8 is a partial detailed chart of FIG. 7.

The above described driving circuit is the same in construction as in FIG. 6. The common driver 13 of the driving circuit described in FIG. 6 is constructed with n number of drivers 6, 6, . . . being cascade connected shown as in FIG. 2, with an exception that a period of the frame scanning start signal YD to be inputted into the driver 6 of the uppermost stage is assumed to have the time corresponding to eight latch pulses, which are more, by three, than the number five of the actual display lines Ca through Ce as shown in FIG. 3(*a*).

The operation of the driving circuit for the liquid crystal display apparatus of the above described construction will be described hereianfter.

Figure 3:
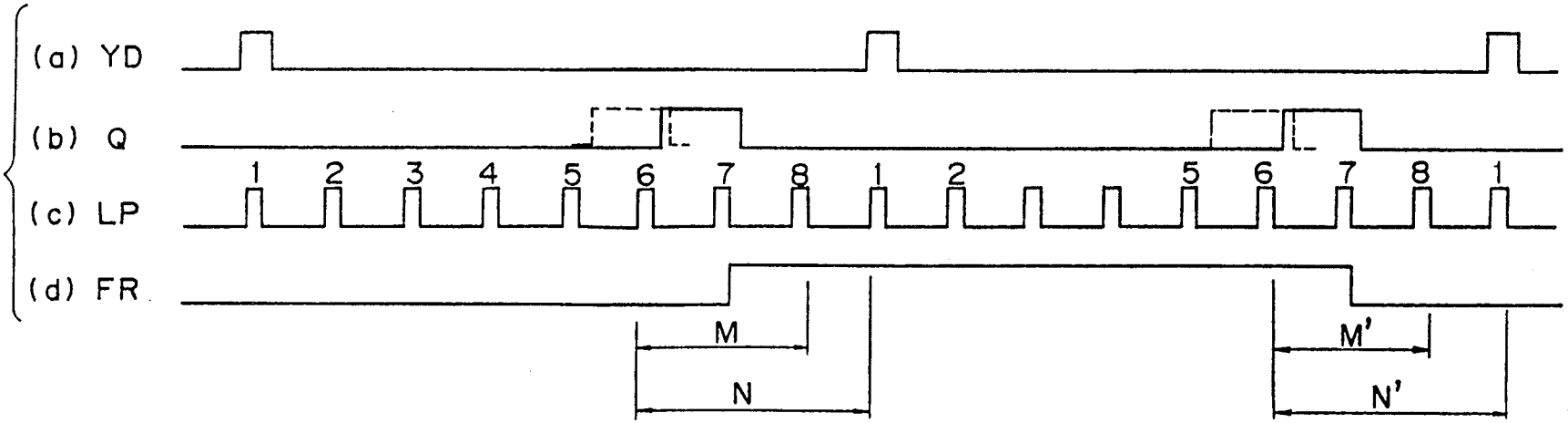
FIG. 3 is a timing chart showing the relationship of signals of the above described alternating signal generating circuit.
Figure 5:
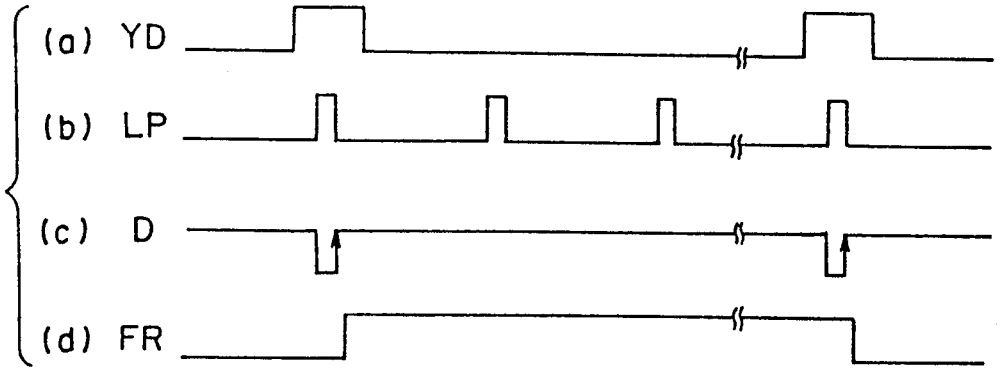
Fig. 5 PRIOR ART
FIG. 5 is a timing chart showing the relationship of the signals of the conventional alternating signal generating circuit.

When the first frame scanning start signal YD is inputted as in FIG. 3(*a*), the common driver is synchronized with the latch pulse LP of FIG. 3(*c*), sequentially, from the driver 6 of the uppermost stage with the alternating signal FR being "L" (see FIG. 3 (*d*)) so as to sequentially output the scanning pulse V0 of the positive polarity sequentially from the top like Ca, cb, . . . into five line shaped electrodes in the line direction of the liquid crystal matrix 11. Simultaneously, the segment driver 12 is synchronized with the latch pulse LP to sequentially output one line portion of the positive polarity of picture elements data V3, V5, sequentially, from the uppermost line into seven line shaped electrodes in the row direction. The respective liquid crystal is driven with the positive polarity of voltage equivalent to the difference of the scanning pulse and the picture element data so as to sequentially effect the lighting operation from the uppermost line. When the driver 6 of the lowermost stage of the common driver 5 synchronizes the lowermost line with the fifth latch pulse LP to complete the driving operation, the pulse signal Di0 for the cascade connection is outputted at such a timing as shown in the broken line of FIG. 3(*b*) from the driver 6 to the D-flip-flop 3 of the alternating signal generating circuit. The pulse signal Di0 inputted into the terminal $\overline{D}$ is latched into the D-flip-flop 3 with the falling of the sixth latch pulse LP, and is inputted into the NAND gate 1 as an output Q delayed by one latch pulse portion as shown in the solid line of FIG. 3(*b*). Since the NAND gate 1 and the D-flip-flop 2 operate the same operation as in the described in FIG. 5, the alternating signal FR which is the output of the D-flop-flop 2 is caused to be reversed into the "H" with the falling of the seventh latch pulse LP. Thereafter, the eighth latch pulse LP is inputted, the next latch pulse becomes a first latch pulse of the second frame, and at the same time, the second frame scanning start signal YD is inputted as in FIG. 3(*a*). Accordingly, from the rising of the sixth latch pulse of the first frame to the rising of the first latch pulse of the second frame, the region becomes an interior N of the non-display display region where the display is not effected on the liquid crystal matrix 11, with the above described quality degraded region M being provided between one latch pulse before and after the reversion of the alternating signal FR within it. The same thing can be said about the reversion to the "L" from "H" of the alternating signal FR by the seventh latch pulse of the second frame, with the display quality degradation region M' by the reversion also being included in the non-display region N'.

According to the above described embodiment, since the polarity of the scanning pulse and the picture element data is reversed within the non-display regions N, N' where the display is not effected on the liquid crystal matrix 11, the turbulence of the driving voltage accompanied by the reversion does not show, thus resulting in no degradation in the display quality. Since the pulse signal Di0, for cascade connection use from the lowermost stage of the common driver 5, is used as the trigger signal of the reversion of the alternating signal FR, the circuit for trigger signal generation use is not required to be especially provided.

If the non-display regions N, N' are made too wide in width, the duty of the latch pulse becomes higher, and the effective value difference in driving voltage signal between on and off becomes smaller. Thus, the contrast of the display will become worse. It is desired that the latch pulse be restrained into the 2 through 4 latch pulse portions. In the above described embodiment, the pulse signal Di0 for cascade connection use is delayed by one latch pulse portion by the use of the D-flip-flop 3, but the pulse signal Di0 may be latched between the one latch pulse on the common driver itself and may be inputted, instead of the frame scanning start signal YD of the NAND gate 1 of FIG. 4.

It is needless to say that the present invention is not restricted to the illustrated embodiment.

As is clear from the foregoing description, according to the arrangement of the present invention, in the driving circuit of the liquid crystal display apparatus of the present invention, a common driver which sequentially drives and outputs in the row direction, the scanning pulses into the other electrode contacting the liquid crystal of a simple matrix type, is composed of a plurality of cascade connected drivers. The frame scanning start signal is inputted, at a time interval corresponding to latch pulses which are more, by a few pulses, than the number of the actual display lines, into the common driver. When the pulse signals for cascade connection use have been outputted from the above described driver of the lowermost stage, an alternating signal which is further delayed by a few latch pulse intervals than the latch pulse of the last line of one frame by the alternating signal generating circuit, and is risingly or loweringly varied to generate the alternating signal generating signal so as to output it into the segment driver, and the common driver so that the the polarity of the scanning pulse and the picture element data may be reversed within the non-display region. Therefore, the turbulence of the driving voltage accompanied by the reversion does not show on the display picture face, thus resulting in no degradation in the display quality of the liquid display apparatus.

Although the present invention has been fully described by way of example with reference to the accompanying drawings, it is to be noted here that various changes and modifications will be apparent to those skilled in the art. Therefore, unless otherwise such changes and the modifications depart from the scope of the present invention, they should be construed as included therein.

We claim:

1. A driving circuit for a liquid crystal display apparatus comprising:

a segment driver for sequentially outputting, line by line, picture element data into a plurality of parallel electrodes contacting a liquid crystal in a first direction;

a common driver for sequentially outputting scanning pulses in a line by line direction into a plurality of parallel electrodes contacting the liquid crystal in a second direction, perpendicular to the first direction, wherein picture elements are formed at electrode intersections; and alternating signal generating means for reversing, for each of constant periods, polarity of the picture element data and the scanning pulses with an alternating signal, so as to drive the respective liquid crystal, said common driver including a plurality of cascade connected drivers, wherein a frame scanning start signal is adapted to be inputted to each cascade connected driver, sequentially, at a time interval corresponding to a number of latch pulses which are greater in number than a number of actual display lines driven by each cascade connected driver, and the alternating signal generating means is adapted to output as the alternating signal, into the segment driver and the common driver, a signal which is delayed by a time interval equal to at least one latch pulse in number and is applied within the time interval of the scanning start signal, to thereby prolong life of the liquid crystal and remove turbulence normally accompanying signal polarity reversion.

2. A driving circuit for a liquid crystal display apparatus comprising:

a segment driver for sequentially outputting, line by line, picture element data into a plurality of parallel electrodes contacting a liquid crystal in a first direction;

a common driver, including a plurality of cascade connected drivers, for sequentially outputting scanning pulses in a line by line direction into a plurality of parallel electrodes contacting the liquid crystal in a second direction, perpendicular to the first direction, wherein picture elements are formed at electrode intersections; and alternating signal generating means for reversing, for each of constant periods, polarity of the picture element data and the scanning pulses with an alternating signal, so as to drive the respective liquid crystal, wherein a frame scanning start signal is adapted to be inputted to each cascade connected driver, sequentially, and the alternating signal generating means is adapted to output as the alternating signal, into the segment driver and the common driver, a signal which is applied during a time interval subsequent to output of scanning pulses to each scanning electrode from a cascaded driver, and prior to output of a next frame scanning start signal to a next cascaded driver, to thereby prolong life of the liquid crystal and remove turbulence normally accompanying signal polarity reversion.

3. A driving circuit for a liquid crystal display apparatus comprising:

a segment driver for sequentially outputting, line by line, picture element data into a plurality of parallel electrodes contacting a liquid crystal in a first direction;

a common driver, including a plurality of cascaded drivers, for sequentially outputting scanning pulses, line by line, to a plurality of parallel electrodes contacting the liquid crystal in a second direction, perpendicular to the first direction; and alternating signal driving means for reversing, for each of a plurality of constant periods, polarity of the picture element data and the scanning pulses, with an alternating signal, wherein the alternating signal is applied during a time period subsequent to output of scanning pulses to each scanning electrode from a cascaded driver, and prior to initiation of output of scanning pulses of a next cascaded driver, to thereby prolong life of the liquid crystal and remove turbulence normally accompanying signal polarity reversion.

4. A method for driving a liquid crystal display apparatus including a plurality of parallel data electrodes contacting a liquid crystal layer in a first direction, a plurality of parallel scan electrodes contacting a liquid crystal layer in a second direction, perpendicular to the first direction, and picture elements formed at scan and data electrode intersections, the method comprising the steps of:

(a) outputting a frame start scanning signal to a plurality of cascaded drivers, in a sequential manner, at time intervals corresponding to a number of latch pulses greater in number than a number of scanning electrodes to be driver, by each cascaded driver;

(b) outputting scanning pulses, sequentially, to each scanning electrode, subsequent to receipt of an output frame start signal, for each cascaded driver;

(c) outputting picture element data, sequentially to each of the data electrodes, through a segment driver; and (d) reversing polarity of the picture element data and the scanning pulses, for each of constant periods, with a reversal of polarity signal, wherein the reversal of polarity signal is a signal applied during a time interval subsequent to output of scanning pulses to each scanning electrode from a cascade driver, and prior to output of a next frame start signal to a next cascaded driver, to thereby prolong life of the liquid crystal and remove turbulence normally accompanying signal polarity reversion.

5. A method for driving a liquid crystal display apparatus including a plurality of parallel data electrodes contacting a liquid crystal layer in a first direction, a plurality of parallel scan electrodes contacting a liquid crystal layer in a second direction, perpendicular to the first direction, and picture elements formed at scan and data electrode intersections, the method comprising the steps of:

(a) outputting a frame start scanning signal to a plurality of cascaded drivers, in a sequential manner;

(b) outputting scanning pulses, sequentially, to each scanning electrode, subsequent to receipt of an output frame start signal, for each cascaded driver;

(c) outputting picture element data, sequentially, to each of the data electrodes, through a segment driver; and (d) reversing polarity of the picture element data and the scanning pulses, for each of constant periods, with a reversal of polarity signal, wherein the reversal of polarity signal is applied subsequent to output of scanning pulses to each scanning electrode from a cascaded driver and prior to output of a next frame start signal to a next cascaded driver, to thereby prolong life of the liquid crystal and remove turbulence normally accompanying signal polarity reversion.

* * * * *